US006541727B2

(12) United States Patent
Beck et al.

(10) Patent No.: US 6,541,727 B2
(45) Date of Patent: Apr. 1, 2003

(54) MOLDED CASE CIRCUIT BREAKER INCLUDING VACUUM SWITCH ASSEMBLY

(75) Inventors: H. Richard Beck, Moon Township, PA (US); Douglas C. Marks, Murrysville, PA (US); R. Michael Slepian, Murrysville, PA (US); Kevin S. Sprinker, Beaver Falls, PA (US); Edward L. Wellner, Colgate, WI (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/859,286

(22) Filed: May 17, 2001

(65) Prior Publication Data

US 2002/0079291 A1 Jun. 27, 2002

Related U.S. Application Data

(63) Continuation-in-part of application No. 09/553,920, filed on Apr. 20, 2000, now abandoned.

(51) Int. Cl.[7] ..... H01H 33/66

(52) U.S. Cl. ..... 218/140; 335/172; 335/174; 200/400; 200/401

(58) Field of Search ..... 218/140, 154; 200/400, 401; 335/172, 174

(56) References Cited

U.S. PATENT DOCUMENTS 4,503,408 A 3/1985 Mrenna et al.
4,540,961 A 9/1985 Maier
4,683,451 A 7/1987 Grunert et al.
4,697,163 A 9/1987 Grunert et al.
4,922,220 A 5/1990 Livesey et al.
4,926,148 A * 5/1990 Cambreleng ..... 200/303
4,935,712 A * 6/1990 Oyama et al. ..... 200/401
4,951,015 A 8/1990 Shea et al.
4,973,928 A 11/1990 Grunert

* cited by examiner

*Primary Examiner*—Elvin Enad
*Assistant Examiner*—M. Fishman
(74) *Attorney, Agent, or Firm*—Martin J. Moran

(57) ABSTRACT

A molded case circuit breaker incorporates vacuum switches operated by a toggle mechanism. Pole arms tied together by a cross bar are rotated simultaneously by the toggle mechanism. A drive link translates the rotational movement of each pole arm into linear movement of a driven member along the axis of the movable electrode of the associated vacuum switch. A coupling bracket has a base section secured to the movable electrode, longitudinal sections straddling the movable electrode axis and terminal sections extending inward toward the plane of rotation of the pole arm from the ends of the longitudinal sections. Coupling members extend from the driven member through slots in the terminal sections of the coupling bracket. Springs couple the free ends of the coupling members to the coupling bracket to open and close the vacuum switch with operation of the toggle mechanism.

6 Claims, 4 Drawing Sheets

MOLDED CASE CIRCUIT BREAKER INCLUDING VACUUM SWITCH ASSEMBLY

This application is a CIP of 09/553,920 (Apr. 20, 2000), now abandoned.

FIELD OF THE INVENTION

The present invention relates to molded case circuit breakers, and more particularly relates to molded case circuit breakers comprising main electrical contacts in the form of vacuum switch assemblies which provide arcless operation.

BACKGROUND INFORMATION

Molded case circuit breakers are well known in the art. Examples of such circuit breakers are disclosed in U.S. Pat. Nos. 4,503,408, 4,540,961, 4,683,451, 4,697,163, 4,922,220, 4,951,015 and 4,973,928, each of which is incorporated herein by reference. Such circuit breakers are used to protect electrical equipment from damage due to an overcurrent condition.

Conventional molded case circuit breakers include at least one pair of separable main contacts which may be operated either manually by way of a handle disposed on the outside of the case or automatically in response to an overcurrent condition. In the automatic mode of operation, the separable main contacts may be opened by either an operating mechanism or by magnetic repulsion forces generated by a reverse electrical current loop formed between upper and lower contact arms.

The separable main contacts of conventional molded case circuit breakers include a fixed contact and a movable contact secured to the free end of a rotatably mounted contact arm. The operating mechanism includes a spring biased toggle mechanism which rotates the contact arm to open and close the separable contacts. The operating mechanism also includes a cradle member having a latching surface. A latch assembly includes pivotally mounted latch levers adapted to engage the latching surface on the cradle member to latch the operating mechanism to close the separable main contacts. When the latch lever is disengaged from the latching surface on the cradle member, the operating mechanism causes the separable main contacts to be opened. A pivotally mounted trip bar engages the latch lever. In a normal position, the trip bar allows the latch lever to latch the operating mechanism. However, when the trip bar is rotated, the latch lever becomes disengaged from the latching surface on the cradle member to allow the operating mechanism to trip or open the separable main contacts.

Various means have been used to actuate the trip bar to cause the separable main contacts to be tripped or opened. For example, bimetallic elements have been used. These bimetallic elements comprise strips of dissimilar metals which bend in response to heat generated by persistent high levels of electrical current. Such bimetallic elements are serially connected between the load and line side terminals of the circuit breaker assembly such that all of the current that passes through the circuit breaker passes through the bimetallic element. Bimetallic elements are generally used to protect electrical circuitry or electrical loads from an overcurrent condition, generally about 200 to 300 percent of the nominal current rating of the circuit breaker.

Another known means of actuating a trip bar is an electronic trip unit. Such devices include internal current transformers electrically coupled to electronic circuitry. The current transformers only allow a portion of the current flowing through the circuit breaker to flow through the tripping device. Electronic trip units are adjustable and may provide overload protection as well as short circuit protection, generally 1,000 percent or more of the nominal current rating of the circuit breaker.

In other circuit breakers, a magnetic tripping device is provided. This tripping device actuates the operating mechanism in response to relatively high overcurrent conditions. Such magnetic tripping devices are serially coupled between the line and load side terminals of the circuit breaker. The magnetic tripping device includes a coil and a reciprocally mounted plunger assembly. The plunger assembly includes a plunger carried by a carrier having a hammer portion which engages the trip bar when the plunger is attracted downwardly by the coil. The plunger is biased upwardly by an operating spring during normal current conditions defining a magnetic air gap between the plunger and the coil. When the electrical current flowing through the circuit breaker is sufficiently high, magnetic attraction forces are generated between the plunger and the coil to overcome the upward spring force on the plunger. This causes the plunger to be attracted downwardly until the hammer portion of the carrier strikes the trip bar causing it to rotate to allow the operating mechanism to unlatch and trip or open the separable main contacts.

Conventional molded case circuit breakers generate an arc when the main contacts are separated to interrupt a current. In conventional designs, the arc is typically exposed to the ambient environment. However, in many installations, such as mines, granaries, bakeries, textile mills and petrochemical plants, such exposed arcs are a safety concern and require special enclosures to be built around the circuit breakers.

Higher voltage, metal clad circuit breakers utilize vacuum interrupters in which the arc generated during contact separation occurs in a vacuum chamber where it is more easily extinguished and does not pose an explosion threat. Typically, these large metal clad breakers utilize a stored energy operating mechanism to generate the force needed to close in on the large currents in the circuits in which they are used. Such mechanisms usually include an arrangement of levers driven by a rotating pole shaft to open and close the vacuum interrupter contacts.

A need exists for relatively small and inexpensive molded case circuit breakers which do not produce exposed arcs during operation.

SUMMARY OF THE INVENTION

The present invention provides a molded case circuit breaker in which the main contacts are provided inside at least one vacuum switch assembly. The molded case circuit breaker includes an over-the-center toggle mechanism which opens and closes the main electrical contacts located inside the vacuum switch assembly. Such molded case circuit breakers are particularly suitable for low and medium voltage applications, and eliminate the need for secondary enclosures in installations where the presence of exposed arcs is a safety consideration.

An aspect of the invention is to provide a molded case circuit breaker comprising: a housing, at least one vacuum switch mounted in the housing and comprising a vacuum envelope containing a fixed contact assembly and a movable contact assembly movable along a longitudinal axis between a closed circuit position in electrical contact with the fixed contact assembly and an open circuit position spaced from the fixed contact assembly. The molded case circuit breaker further includes a pole arm, a support frame mounting the pole arm for pivoting in a plane of rotation, and an operating mechanism incorporating a toggle mechanism which rotates the pole arm. A mount supports a driven member for movement along a path substantially parallel to the longitudinal axis of the moving contact assembly. A drive link connects the driven member to the pole arm to translate rotation of the pole arm into linear movement of the driven member, and a coupler couples the driven member to the movable contact assembly to move the movable contact assembly between the open and closed positions with the linear movement of the driven member.

This and other aspects of the present invention will be more apparent from the following description.

DETAILED DESCRIPTION

Figure 2:
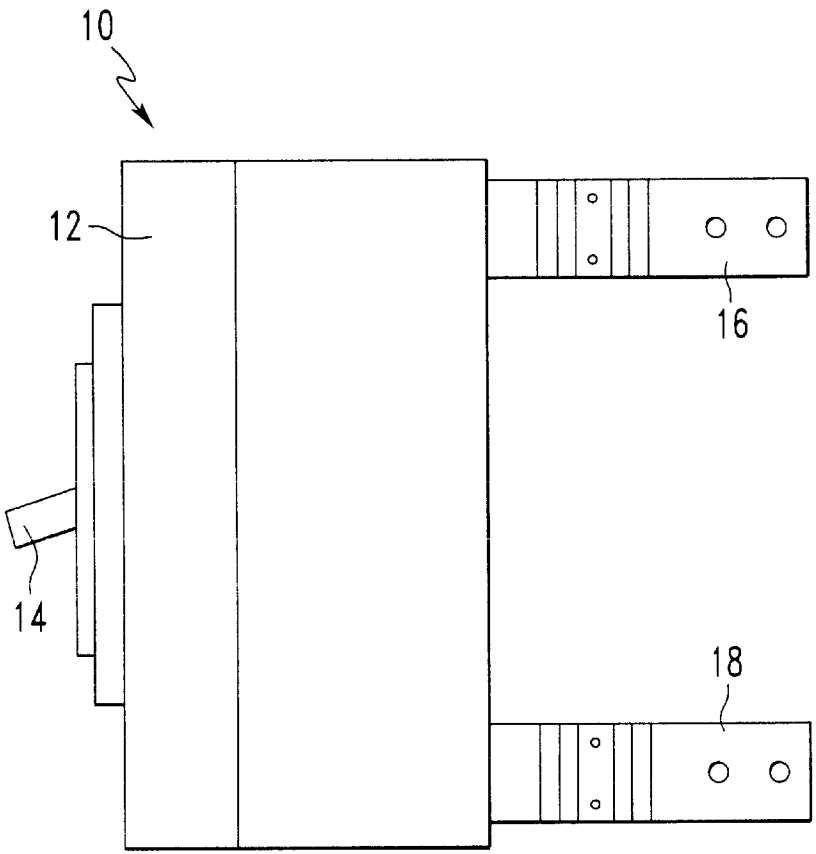
FIG. 2 is a side view of the molded case circuit breaker of FIG. 1.
Figure 1:
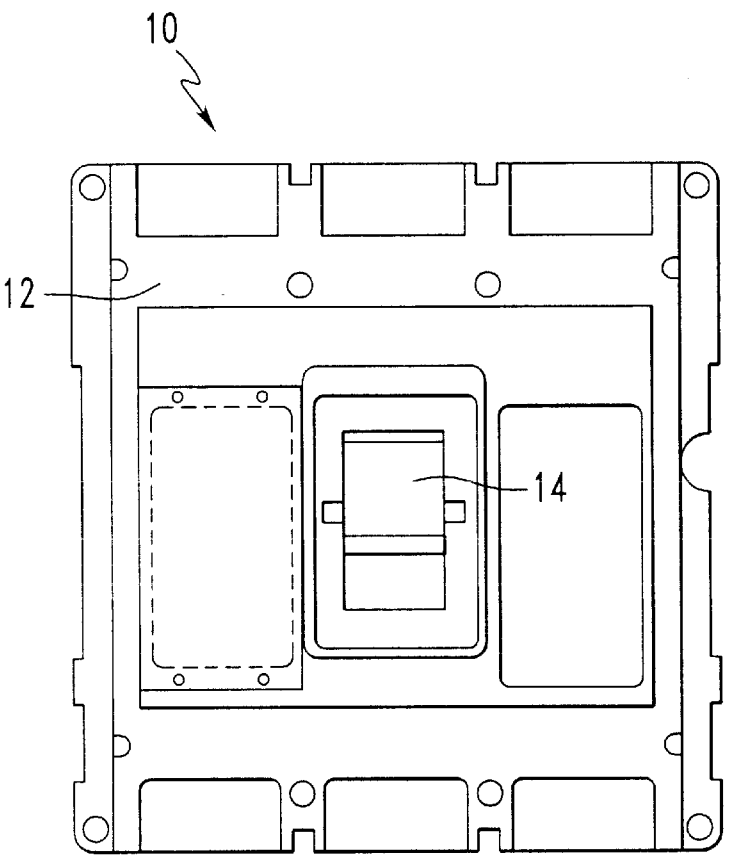
FIG. 1 is a front view of a molded case circuit breaker in which the main electrical contacts are contained within vacuum interrupter assemblies in accordance with an embodiment of the present invention.

FIGS. 1 and 2 illustrate the exterior of a molded case circuit breaker 10 in accordance with an embodiment of the present invention. The molded case circuit breaker 10 includes a case or housing 12 and an operating member in the form of a handle 14 which may be manually moved to open and close the circuit breaker. The housing 12 is preferably molded from a conventional polymeric material. As shown most clearly in FIG. 2, the molded case circuit breaker 10 includes electrical conductors 16 and 18 extending from the housing 12. The molded case circuit breaker 10 shown in FIGS. 1 and 2 is a three pole breaker. Alternatively, the molded case circuit breakers of the present invention may include one, two or more poles.

Figure 3:
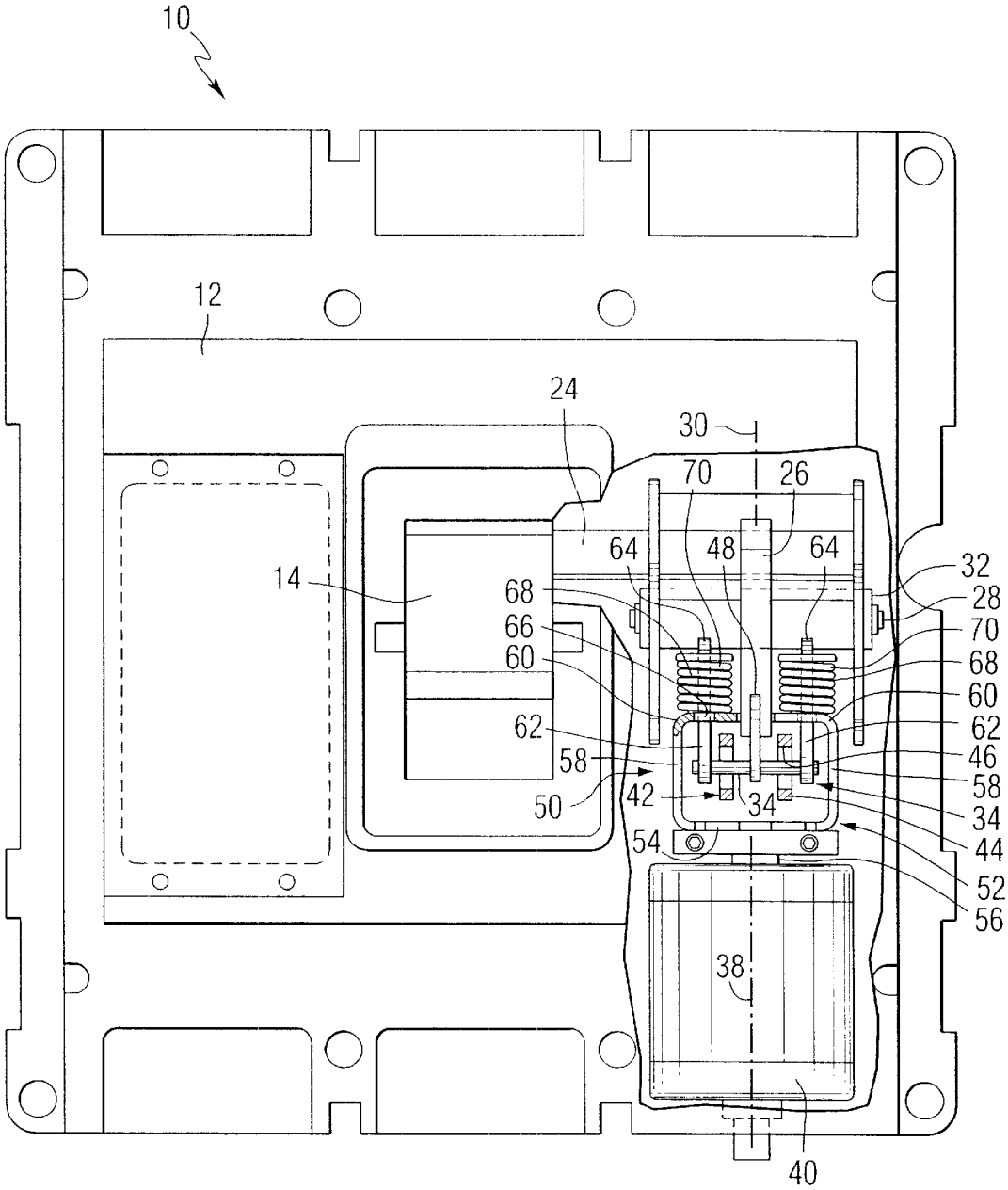
FIG. 3 is a partially schematic broken away front view of a molded case circuit breaker showing a vacuum interrupter main electrical contact assembly in accordance with an embodiment of the present invention.
Figure 4:
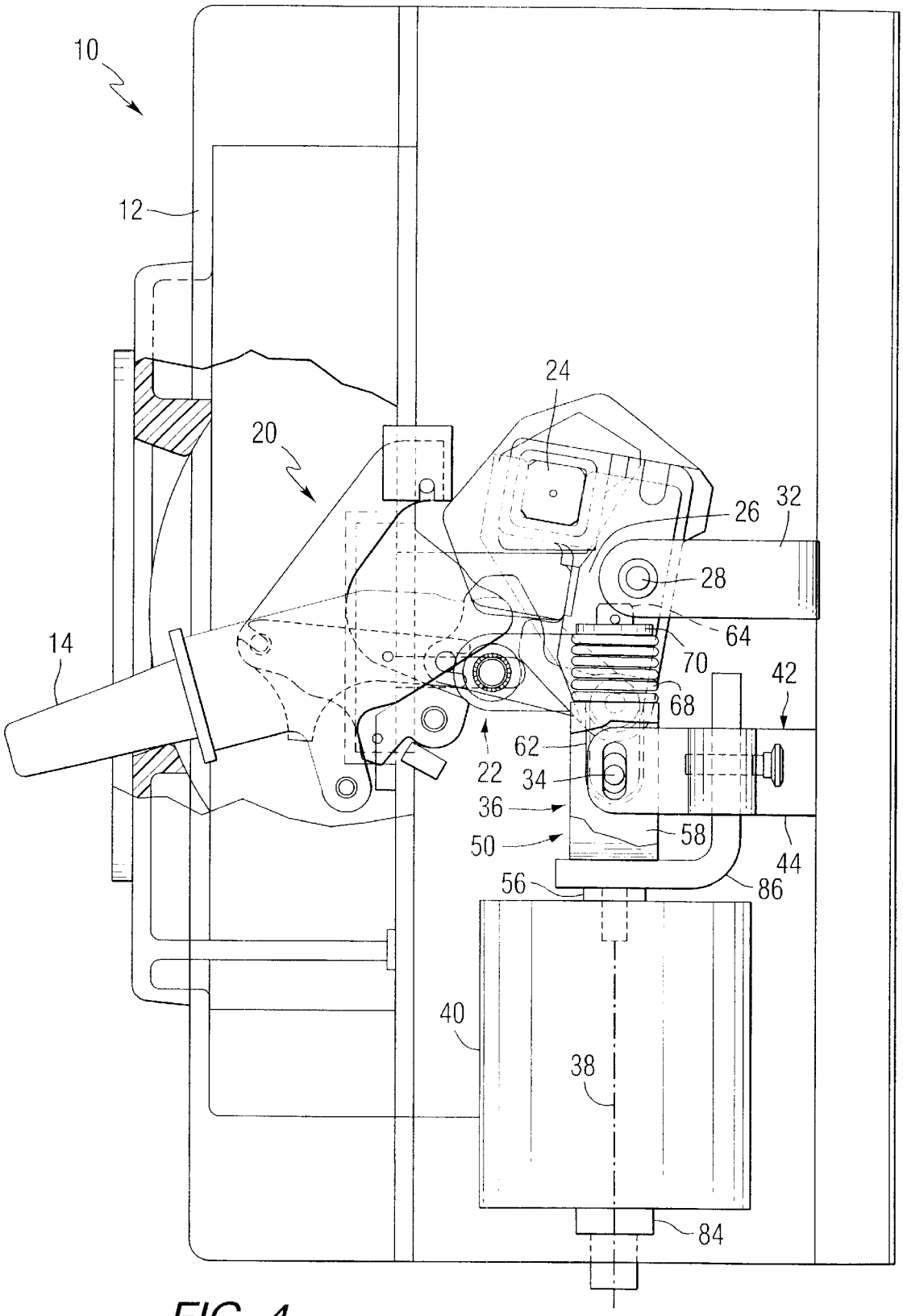
FIG. 4 is a partially schematic side sectional view of a molded case circuit breaker of the present invention, including an over-the-center toggle mechanism, trip bar and vacuum interrupter main electrical contact assembly.

FIG. 3 is a partially schematic broken away front view of the molded case circuit breaker 10, and FIG. 4 is a partially schematic side sectional view of the molded case circuit breaker. As shown most clearly in FIG. 4, the switch 14 is connected to a conventional molded case circuit-breaker operating mechanism 20 incorporating an over-the-center toggle mechanism 22.

A cross bar 24 extends across the inside of the housing 12. A pole arm 26 for each pole of the circuit breaker is mounted by a support pin 28 for pivoting in a plane of rotation. The support pin 28 for each pole is mounted in a support frame 32. The toggle mechanism 22 is connected to one of the pole arms 26, typically the center pole arm, in a three pole breaker. All of the pole arms 26 are connected together by the cross bar 24 so that rotation of the one pole arm by the toggle mechanism 22 results in simultaneous rotation of all of the pole arms.

Associated with each pole arm 26 is a driven member in the form of a rod 34 extending transverse to the plane of rotation 30 of the pole arm. This rod 34 is supported by a mount 36 for movement along a linear path which is substantially parallel to a longitudinal axis 38 of the vacuum switch 40 of the pole. This mount 36 is in the form of a mounting bracket 42 having a pair of spaced apart legs 44. Closed-ended slots 46 in the legs 44 define the linear path for the driven member 34.

A drive link 48 connects the rod 34 with the associated pole arm 26 so that rotation of the pole arm 26 is translated into linear movement of the rod 34.

A coupler 50 couples the rod 34 to the moving contact assembly 82 of the vacuum switch 40. This coupler 50 includes a coupling bracket 52 having a base section 54 mounted on the movable electrode 56 of the vacuum switch 40 and extending transversely to the longitudinal axis 38 of the switch. The coupling bracket 52 has longitudinal sections 58 extending from the base section 54 and straddling the plane of rotation 30 of the pole arm 26. Terminal sections 60 extend transversely inward from the longitudinal sections 58 toward the plane of rotation 30 of the link arm 26. A pair of coupling members 62 extend from the rod 34 in a direction away from the vacuum switch 40. These coupling members 62 have free ends 64 which are positioned beyond the terminal sections 60 of the coupling bracket 52. Preferably, the free ends 64 of the coupling member 62 extend through slots 66 in the terminal sections 60. A pair of helical compression springs 68 extend between the terminal sections 60 and stop plates 70 on the free ends 64 of the coupling member 62. Other types of springs, such as Bellville washers could be used in place of the helical compression springs.

Figure 5:
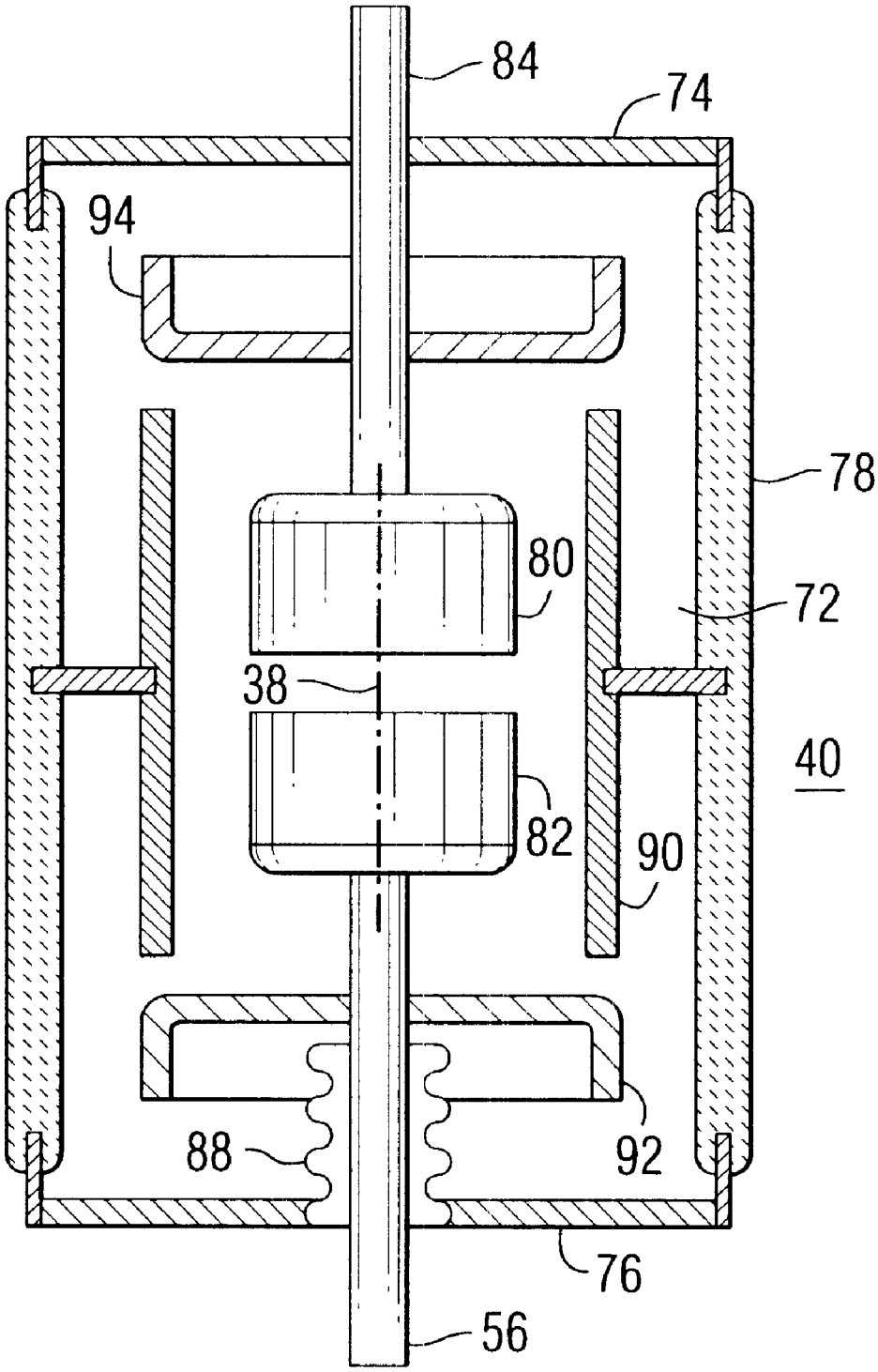
FIG. 5 is a partially schematic side sectional view of a vacuum interrupter contact assembly which may be installed in a molded case circuit breaker in accordance with an embodiment of the present invention.

Referring to FIG. 5, the vacuum interrupter 40 includes a vacuum envelope 72 having spaced conducting end caps 74 and 76 joined by a tubular insulating casing 78. Fixed and movable main contact assemblies 80 and 82 of the molded case circuit breaker 10 define the common longitudinal axis 38 within the vacuum envelope 72. The movable electrode 56 is electrically coupled to the movable contact assembly 82, while a fixed electrode 84 connected to the fixed main contact assembly 80 extends out the casing 78 to form a line side conductor. A conductor 86 connected to the movable electrode 56 forms the load side conductor (see FIG. 4). A mechanism, such as a bellows assembly 88, permits linear movement of movable contact assembly 56 along the longitudinal axis 38 between an open circuit position and a closed circuit position (not shown). An optional vapor shield 90 that is either electrically isolated from the electrode assemblies 84 and 56, or connected to only one of the electrodes, may surround both contact assemblies 80,82 to keep metal vapors from collecting on the insulating casing 78. An optional bellows vapor shield 92 may keep metal vapors off the bellows assembly 88, while another optional shield 94 collects metal vapors at the other end of the interrupter.

In accordance with the present invention, actuation of the operating mechanism 20, either by the handle 14 or a trip unit (not shown) results in rotation of all of the pole arms 26 through the toggle mechanism 22 coupled to one pole and the cross bar 24 tying all of the pole arms together. As a pole arm 26 is rotated counterclockwise to the closed position shown in FIG. 3, the drive link 48 translates rotation of the pole arm 26 into linear movement of the rod 34 along the slots 46. The coupling members 62 connected to the rod 34 then pull down on the springs 68 as viewed in FIG. 3. These springs 68 in turn push down on the coupling bracket 52 which moves the movable electrode 56 downward to close the vacuum interrupter. The springs 68 exert a desired closing force on the contacts of the vacuum interrupter and also accommodate for wear of these contacts. When the pole arms 26 are subsequently rotated clockwise as viewed in FIG. 4, the rod 34 moves upward in FIG. 3 thereby pushing the springs 68 upward. The springs being secured to the terminal sections 60 then pull the coupling bracket 52 upward which opens the vacuum interrupter.

The molded case circuit breakers of the present invention are particularly suitable for low voltage applications, e.g., up to about 600 volts, and medium voltage applications, e.g., up to about 5 kV or higher.

The following example is intended to illustrate various aspects of the present invention, and is not intended to limit the scope thereof.

EXAMPLE 1

A 1,200 A, 4.2 kV molded case circuit breaker of the present invention similar to that shown in FIGS. 1–4 having an interruption rating of over 16 kA is constructed. The molded case circuit breaker is of similar construction to a commercially available R-Frame Westinghouse Series C circuit breaker sold by Cutler-Hammer. However, the R-Frame circuit breaker is modified in accordance with the present invention to include three vacuum interrupters and associated linkages in place of the conventional exposed main electrical contact mechanisms. The vacuum interrupters are similar to those commercially available from Cutler-Hammer as Model No. WL-35241. However, the vacuum interrupters are provided with a bellows arrangement within the vacuum bottle for high current operation and increased mechanical life, and include a high dielectric strength potting material for increased voltage operation. A compact linkage similar to that shown in FIGS. 3 and 4 connects the pole arm of each pole with the vacuum interrupter, thereby converting the rotational movement of the pole arm to a high-force, short-stroke linear motion required for the axial contact operation of the vacuum interrupter.

Whereas particular embodiments of this invention have been described above for purposes of illustration, it will be evident to those skilled in the art that numerous variations of the details of the present invention may be made without departing from the invention as defined in the appended claims.

What is claimed:

1. A molded case circuit breaker comprising:

a housing;

at least one vacuum switch mounted in the housing and comprising a vacuum envelope containing a fixed contact assembly and a movable contact assembly movable along a longitudinal axis between a closed circuit position in electrical contact with the fixed contact assembly and an open circuit position spaced from the fixed contact assembly;

a pole arm;

a support frame mounting the pole arm for pivoting in a plane of rotation;

an operating mechanism incorporating a toggle mechanism rotating the pole arm in the plane of rotation;

a driven member;

a mount mounting the driven member for linear movement along a path substantially parallel to the longitudinal axis of the moving contact assembly;

a drive link connecting the driven member to the pole arm to translate rotation of the pole arm into linear movement of the driven member; and a coupler coupling the driven member to the movable contact assembly to move the movable contact assembly between the open and closed positions with the linear movement of the driven member.

2. The molded case circuit breaker of claim 1 wherein the mount comprises a mounting bracket having a pair of spaced legs defining a pair of closed-ended slots extending substantially parallel to the longitudinal axis of the movable contact assembly and in which the driven member slides along the linear path.

3. The molded case circuit breaker of claim 2 wherein the coupler comprises a coupling bracket engaging the movable contact assembly, at least one coupling member secured to and movable with the driven member, and at least one spring connected between and transmitting force between the at least one coupling member and the coupling bracket.

4. The molded case circuit breaker of claim 3 wherein the driven member is an elongated member extending transversely to the plane of rotation of the pole arm and the coupler comprises two coupling members secured to the elongated member and straddling the plane of rotation of the pole arm and two springs each connected between one of the coupling members and the coupling bracket.

5. The molded case circuit breaker of claim 4 wherein the coupling bracket has a base section connected to and extending transversely to the longitudinal axis of the movable contact assembly, two longitudinal sections extending from the base section and straddling the plane of rotation of the pole arm, and terminal sections extending transversely inward from the longitudinal sections toward the plane of rotation of the pole arm, the coupling members extending away from the vacuum switch with free ends positioned beyond the terminal sections of the coupling bracket and the springs being connected between the free ends of the coupling members and the terminal sections of the coupling bracket.

6. The molded case circuit breaker of claim 5 wherein the terminal sections of the coupling brackets have openings through which the coupling members extend.

* * * * *